US010030929B1

(12) United States Patent
Lessard

(10) Patent No.: US 10,030,929 B1
(45) Date of Patent: Jul. 24, 2018

(54) INTEGRAL ECCENTRIC FIREARM SILENCER

(71) Applicant: Sig Sauer, Inc., Newington, NH (US)

(72) Inventor: Ethan Lessard, East Kingston, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/447,304

(22) Filed: Mar. 2, 2017

Related U.S. Application Data

(60) Provisional application No. 62/302,506, filed on Mar. 2, 2016.

(51) Int. Cl.
*F41A 21/30* (2006.01)
*F41C 3/00* (2006.01)

(52) U.S. Cl.
CPC ..... *F41A 21/30* (2013.01); *F41C 3/00* (2013.01)

(58) Field of Classification Search
CPC ..... F41A 21/30
USPC ..... 89/14.4; 181/223
See application file for complete search history.

(56) References Cited

U.S. PATENT DOCUMENTS 2,468,926 A * 5/1949 Garrett ..... F41A 21/34 181/223
3,385,164 A 5/1968 Karl-Heinz et al.
4,454,798 A * 6/1984 Shea ..... F41A 21/30 181/223
4,588,043 A * 5/1986 Finn ..... F41A 21/30 181/223
5,136,924 A * 8/1992 Förster ..... F41A 21/30 89/14.4
5,425,299 A * 6/1995 Teetzel ..... F41A 9/62 42/1.02
6,308,609 B1 10/2001 Davies
6,374,718 B1 4/2002 Rescigno et al.
8,167,084 B1 5/2012 Moore
8,286,750 B1 10/2012 Oliver
8,490,535 B1 7/2013 Moore et al.
8,522,662 B2 9/2013 Presz, Jr. et al.
8,579,075 B2 * 11/2013 Brittingham ..... F41A 21/30 181/223

(Continued)

FOREIGN PATENT DOCUMENTS

EP 1764577 A1 * 3/2007 ..... F41A 21/30
WO 2015016998 A2 2/2015

*Primary Examiner* — Bret Hayes
(74) *Attorney, Agent, or Firm* — Finch & Maloney, PLLC

(57) ABSTRACT

An eccentric firearm silencer includes an elongate body having a projectile entry end, a projectile exit end opposite the projectile entry end, a bore extending through the projectile entry end and the projectile exit end for conducting a projectile therethrough, and a longitudinal axis X passing through the bore. The elongate body is configured to be coupled, rotatably about or slidably parallel to the longitudinal axis X, to a barrel of the firearm at or near the projectile entry end. The elongate body includes a propellant gas expansion chamber disposed adjacent to, and in fluid communication with, the bore for receiving a propellant gas. The elongate body includes a capsule container mounted eccentrically adjacent to, and in fluid communication with, the propellant gas expansion chamber. The capsule container is configured to receive therein a capsule or ablative cartridge containing an amorphous solid or a liquid.

20 Claims, 6 Drawing Sheets

(56) References Cited

U.S. PATENT DOCUMENTS

| | | | | |
|---|---|---|---|---|
| 9,052,152 | B2 | 6/2015 | Moss et al. | |
| 9,175,920 | B2 | 11/2015 | Moore | |
| 9,347,727 | B1 | 5/2016 | Cler | |
| 9,835,399 | B1 | 12/2017 | Lessard | |
| 2007/0107590 | A1* | 5/2007 | Silvers | F41A 21/30 89/14.4 |
| 2009/0200105 | A1* | 8/2009 | Geyer, III | F01N 1/082 181/243 |
| 2011/0067950 | A1* | 3/2011 | Shults | F41A 21/30 181/223 |
| 2012/0272818 | A1 | 11/2012 | Dueck et al. | |
| 2014/0262605 | A1* | 9/2014 | Washburn, III | F41A 21/30 181/223 |
| 2014/0353076 | A1* | 12/2014 | Bethlenfalvy | F41A 21/30 181/223 |
| 2014/0360807 | A1 | 12/2014 | McKenzie | |
| 2015/0260472 | A1 | 9/2015 | Smith | |
| 2016/0084602 | A1* | 3/2016 | Smith | F41A 21/325 89/14.4 |
| 2016/0109205 | A1 | 4/2016 | Coppinger et al. | |
| 2016/0238335 | A1 | 8/2016 | Bertschinger et al. | |

* cited by examiner

INTEGRAL ECCENTRIC FIREARM SILENCER

RELATED APPLICATION

This application claims the benefit under 35 U.S.C. § 119(e) of U.S. Provisional Patent Application Ser. No. 62/302,506, entitled "INTEGRAL ECCENTRIC PISTOL SILENCER" and filed on Mar. 2, 2016, which is incorporated herein by reference in its entirety.

FIELD OF THE DISCLOSURE

This disclosure relates generally to firearm noise suppression, and more particularly, to an integral eccentric firearm silencer.

BACKGROUND

A silencer is a device attached to the barrel of a firearm that reduces the amount of noise generated during firing. Noise suppression is typically achieved by allowing the rapidly expanding gases from the firing of the cartridge to be decelerated and cooled through a series of chambers. Silencers can be detachable ("can"-type) or integral to the muzzle end of the barrel. Can-type silencers must be indexed to the barrel using complex mechanical clutches, gears or keys. Furthermore, some existing silencers have a large diameter that obscures the sites located on the handgun and prevents the handgun from being holstered with the silencer attached.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
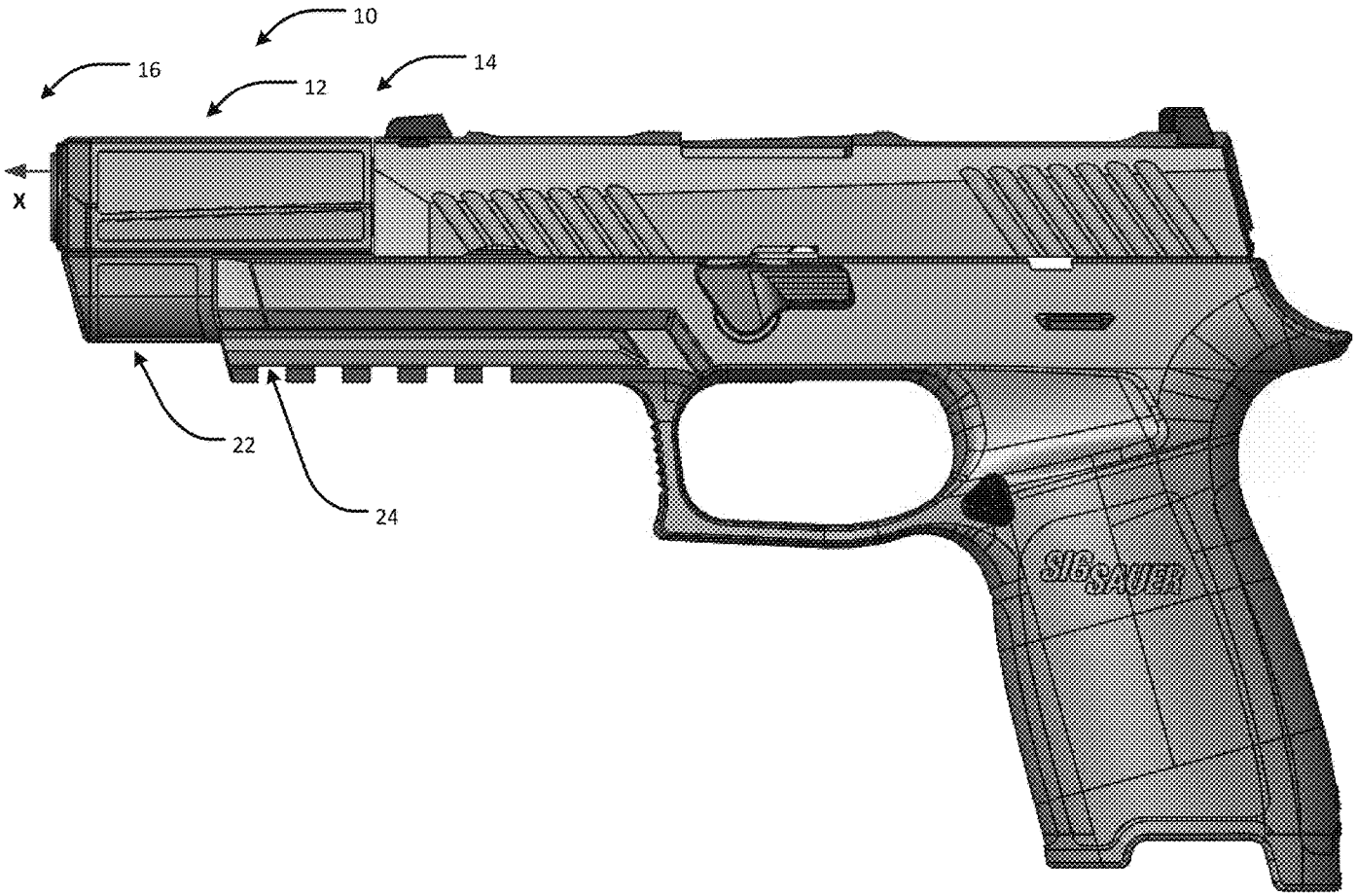
FIG. 1 is a left side view of an example firearm assembly, according to an embodiment of the present disclosure.
Figure 2:
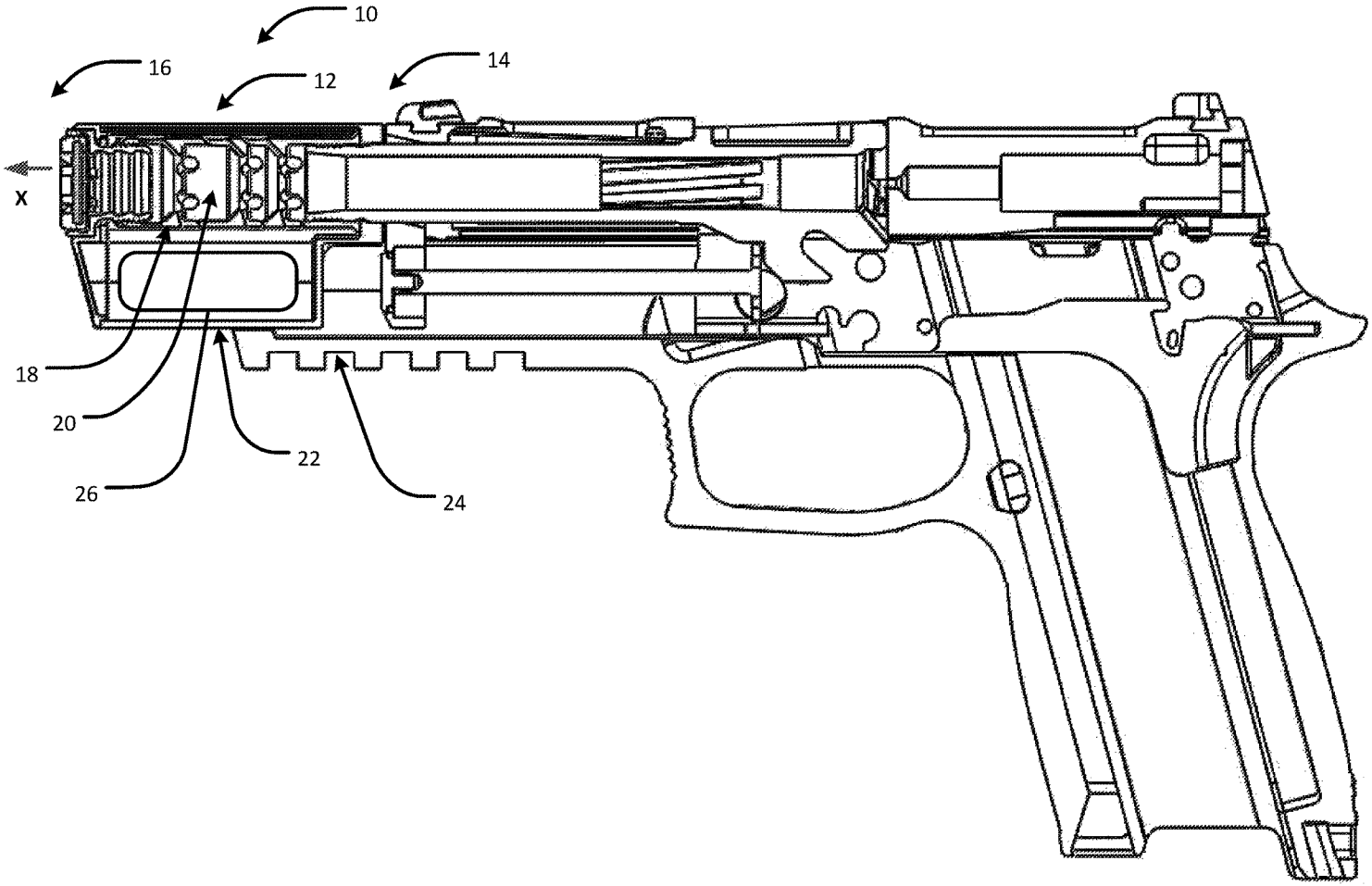
FIG. 2 is a left side cross-sectional view of the example firearm assembly of FIG. 1, according to an embodiment of the present disclosure.
Figure 3:
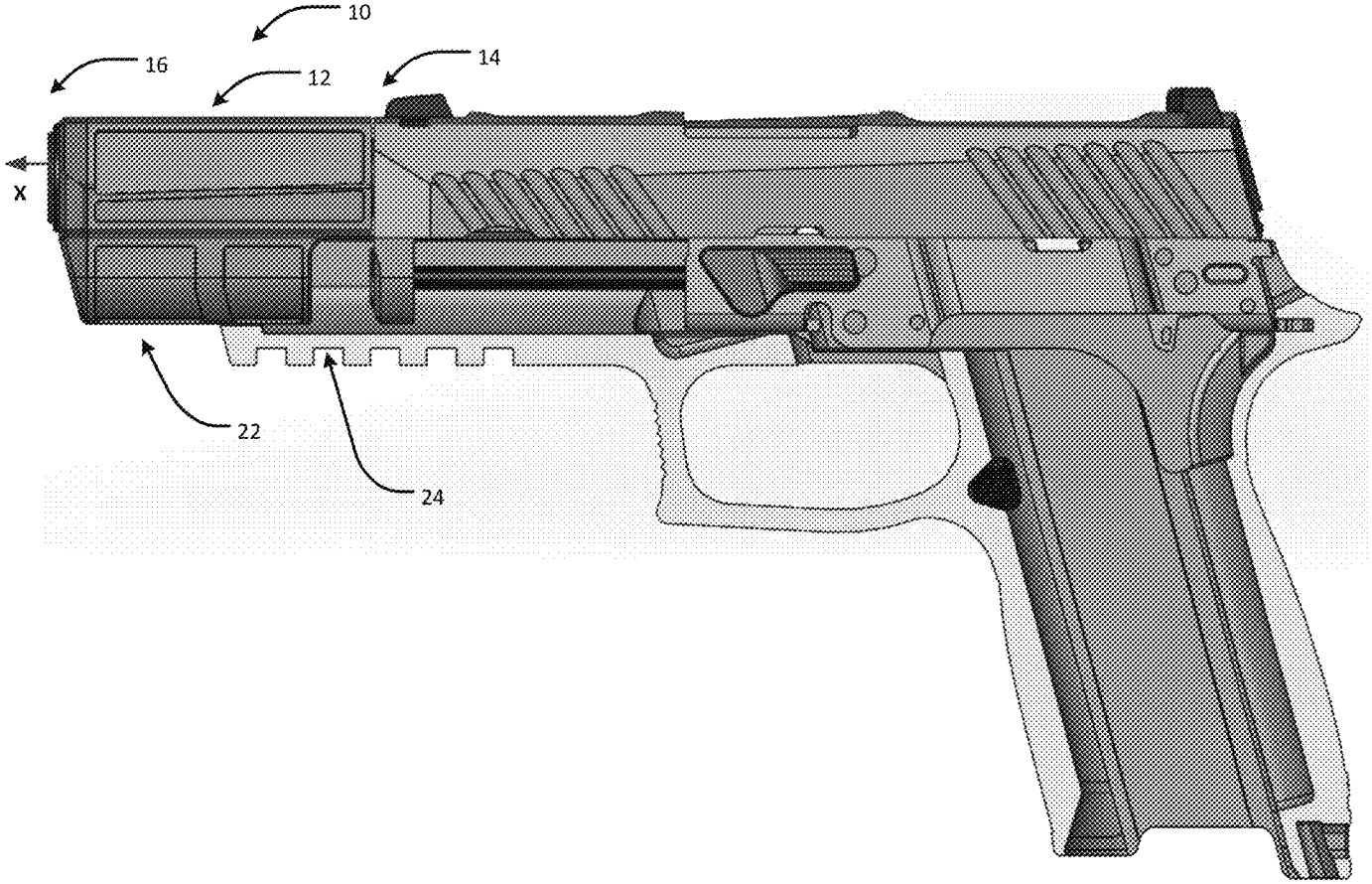
FIG. 3 is a left side view of an example firearm assembly, according to an embodiment of the present disclosure.
Figure 4:
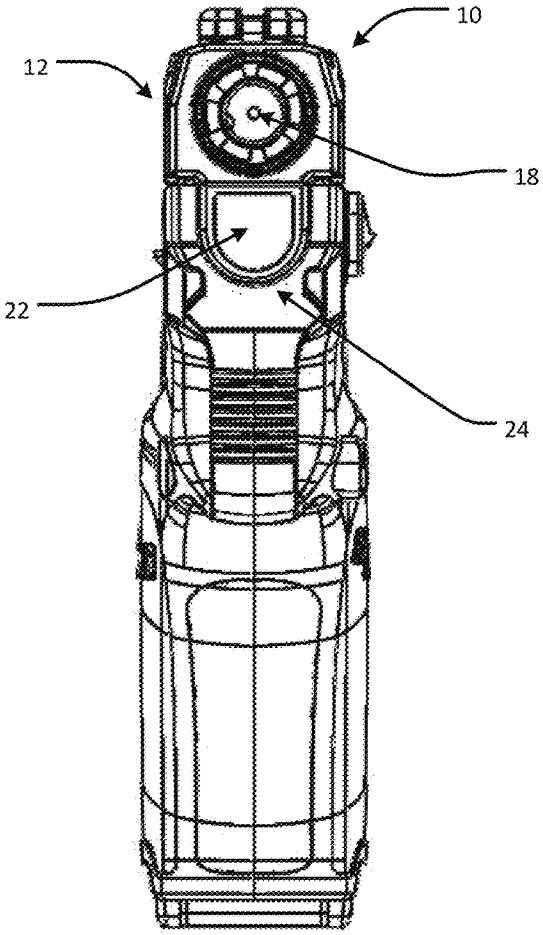
FIG. 4 is a front view of an example firearm assembly, according to an embodiment of the present disclosure.
Figure 5:
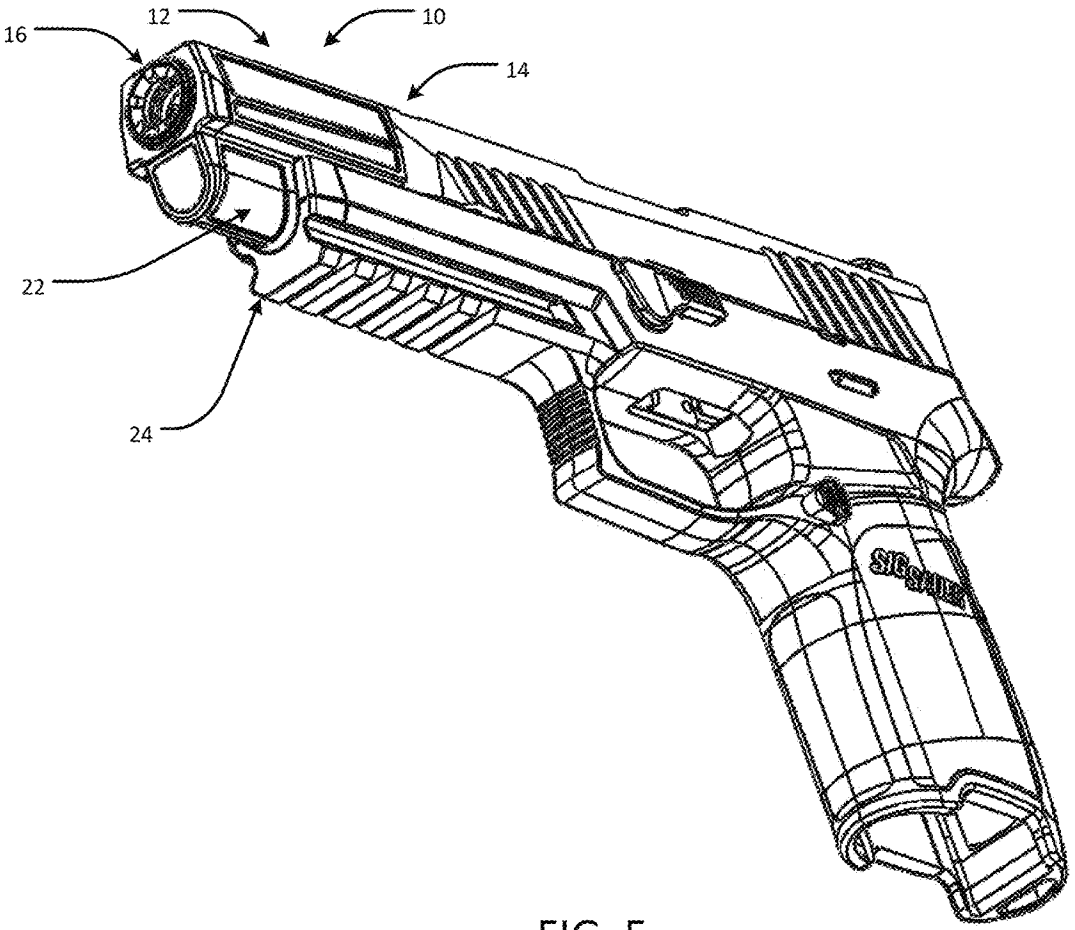
FIG. 5 is a lower left front perspective view of an example firearm assembly, according to an embodiment of the present disclosure.
Figure 6:
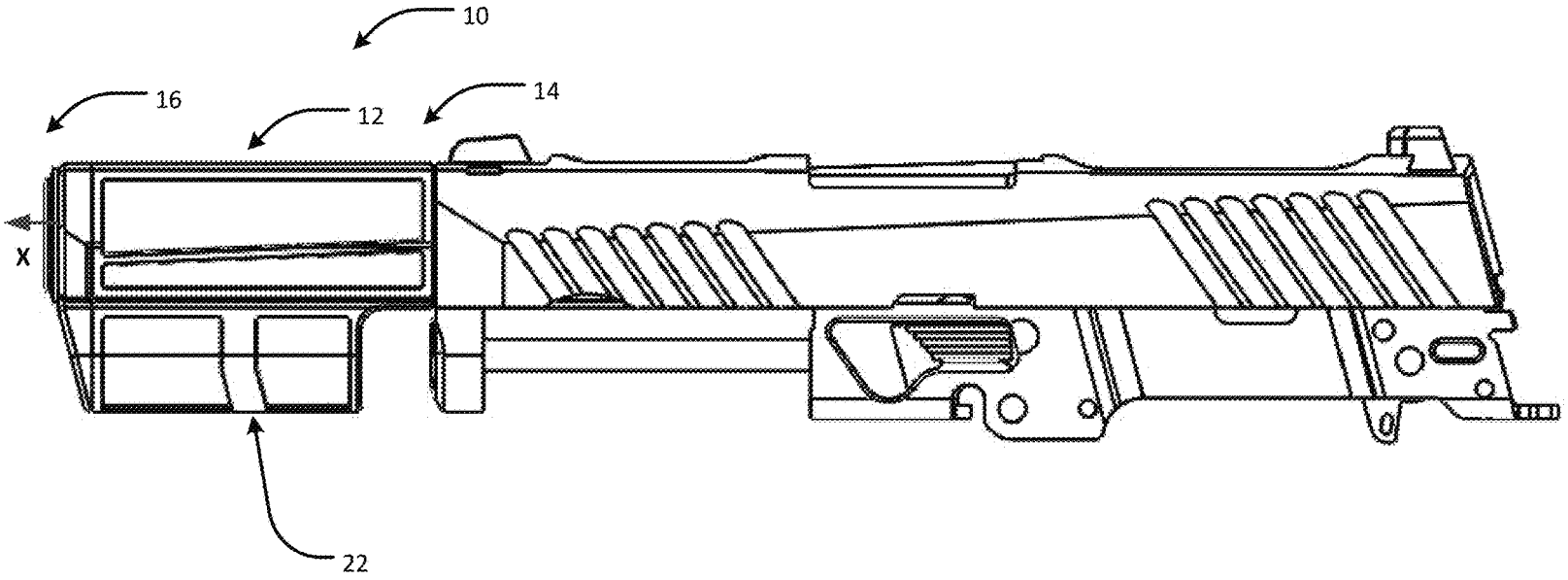
FIG. 6 is a left side view of an example firearm assembly, according to an embodiment of the present disclosure.

In accordance with a set of embodiments, example integral eccentric silencers for a firearm, such as a pistol, are disclosed. Reference is made to FIGS. 1-6, where FIG. 2 is a side cross-sectional view of an example embodiment and FIGS. 1 and 3-6 are side, front and perspective views of several example embodiments, respectively. According to an embodiment, an eccentric silencer 10 includes an elongate body 12 having a projectile entry end 14, a projectile exit end 16 opposite the projectile entry end 14, a bore 18 extending through the projectile entry end 14 and the projectile exit end 16 for conducting a projectile therethrough, and a longitudinal axis X passing through the bore

18. The elongate body 12 is configured to be coupled, rotatably about or slidably parallel to the longitudinal axis X, to a barrel of the firearm at or near the projectile entry end 14. The elongate body 12 includes a propellant gas expansion chamber 20 disposed adjacent to, and in fluid communication with, the bore 18 for receiving a propellant gas (e.g., FIG. 2). The propellant gas expansion chamber 20 is internal to at least a portion of the elongate body 12. The elongate body 12 includes a capsule container 22 mounted eccentrically adjacent to, and in fluid communication with, the propellant gas expansion chamber 20 (e.g., FIG. 2). For example, the capsule container 22 may be mounted above or below the bore 18. The capsule container 22 is internal to at least a portion of the elongate body 12. The capsule container 22 is configured to receive therein a capsule or ablative cartridge 26 (e.g., FIG. 2) containing an amorphous solid or a liquid. The capsule 26 can, in some embodiments, be replaceable or removable from the capsule container 22.

As the projectile moves through the barrel of the firearm, the capsule 26 is configured to rupture in response to an application of a pressure wave traveling ahead of the projectile while the capsule 26 is installed within the capsule container 22, thereby causing least a portion of the contents to be released from the capsule 26 and into the propellant gas expansion chamber 20. The amorphous solid or the liquid released from the capsule 26 reduces a temperature of propellant gas associated with the pressure wave, which in turn reduces a pressure of the propellant gas, thereby suppressing a noise level associated with the propellant gas as the propellant gas expands into the propellant gas expansion chamber 20. Some embodiments include or are configured to include a so-called wet suppressor, which uses a small quantity of water, oil, grease, gel, or other amorphous solid or liquid in the expansion chambers to cool the propellant gases. This has the effect of reducing the pressure of the gases, as evidenced by the ideal gas law, which in turn reduces the noise created by the expanding gases. In some embodiments, the capsule 26 contains water, oil, grease, gel, or other amorphous solid or liquid. In some embodiments, the eccentric silencer 10 includes the capsule 26 in the capsule container 22; however, it will be understood that the capsule 26 can be removable, disposable and replaceable (e.g., a single use and user-replaceable item) and does not necessarily form a portion of the silencer 10. Numerous configurations and variations will be apparent in light of this disclosure.

In some embodiments, a dustcover 24 of the firearm can be used to rotationally align the elongate body 12 of the eccentric silencer 10 with the firearm. The eccentric silencer 10 can, in some embodiments, be configured and dimensioned such that the firearm can be holstered while the silencer 10 is coupled to barrel of the firearm. In some embodiments, the eccentric silencer 10 is a hearing-safe silencer.

In one example use case, a slider of the firearm may be moved along the X axis to rotationally time (align) the eccentric silencer 10 with a grip of the firearm. The eccentric silencer 10 may alternatively be mounted on guide rails (slide rather than rotate), with a jamb nut that can crush and thereby secure the silencer 10 against the barrel of the firearm.

The capsule 26 may be sealed such that upon firing or discharging the firearm, the pressure wave ahead of the bullet or projectile causes the capsule 26 to break or rupture, which releases the contents of the capsule 26 into at least a portion of the propellant gas expansion chamber 20. The amorphous solid or liquid released from the capsule 26 muffles the sound (e.g., to approximately 130 decibels) by lowering the temperature and/or pressure of the propellant gases. The contents of the capsule 26 may include, for example, water, antifreeze, or a wire pulling polymer lubricant gel, although other materials may be used, as will be apparent in light of this disclosure. An example of a wire pulling polymer lubricant gel is a thixotropic gel such as WL Wire Pulling Lubricant Gel, Part No. WL-1, manufactured by 3M Company of Maplewood, Minn., or a substantially equivalent material.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Subsequent applications claiming priority to this application may claim the disclosed subject matter in a different manner and generally may include any set of one or more limitations as variously disclosed or otherwise demonstrated herein.

What is claimed is:

1. An eccentric silencer for a firearm comprising:

an elongate body having a projectile entry end, a projectile exit end opposite the projectile entry end, a bore extending through the projectile entry end and the projectile exit end for conducting a projectile therethrough, and a longitudinal axis passing through the bore, the body being configured to be coupled to a barrel of the firearm at the projectile entry end;

the elongate body further having a propellant gas expansion chamber disposed adjacent to, and in fluid communication with, the bore for receiving a propellant gas;

the elongate body further having a capsule container mounted eccentrically adjacent to, and in fluid communication with, the propellant gas expansion chamber; and a capsule installed in the capsule container, the capsule being sealed and containing at least one of an amorphous solid and a liquid.

2. The eccentric silencer of claim 1, wherein the propellant gas expansion chamber is configured to receive at least one of the amorphous solid and the liquid from the capsule via the capsule container.

3. The eccentric silencer of claim 1, wherein the sealed capsule is configured to rupture in response to an application of a pressure wave traveling ahead of the projectile while the capsule is installed in the capsule container, thereby causing least a portion of the contents to be released from the ruptured capsule and into the propellant gas expansion chamber, wherein the released amorphous solid or the released liquid reduces a temperature of the propellant gas associated with the pressure wave, which in turn reduces a pressure of the propellant gas thereby suppressing a noise level associated with the propellant gas as the propellant gas expands into the propellant gas expansion chamber.

4. The eccentric silencer of claim 1, wherein the capsule is an ablative cartridge that is removable from the capsule container.

5. The eccentric silencer of claim 1, wherein the capsule contains at least one of water, antifreeze and a wire pulling polymer lubricant gel.

6. The eccentric silencer of claim 1, wherein the elongate body is configured to be rotatably coupled to the barrel of the firearm about the longitudinal axis.

7. The eccentric silencer of claim 1, wherein the elongate body is configured to be slidably coupled parallel to the barrel of the firearm.

8. The eccentric silencer of claim 1, wherein the capsule contains a polymer lubricant gel.

9. The eccentric silencer of claim 1, further comprising a dustcover, wherein the elongate body is rotationally aligned with the dustcover.

10. A kit comprising:

an eccentric silencer comprising an elongate body having a projectile entry end, a projectile exit end opposite the projectile entry end, a bore extending through the projectile entry end and the projectile exit end for conducting a projectile therethrough, and a longitudinal axis passing through the bore, the body being configured to be coupled to a barrel of a firearm at the projectile entry end, the elongate body further having a propellant gas expansion chamber disposed adjacent to, and in fluid communication with, the bore for receiving a propellant gas, and the elongate body further having a capsule container mounted eccentrically adjacent to, and in fluid communication with, the propellant gas expansion chamber; and a capsule configured to be installed in the capsule container, the capsule being sealed and containing one of an amorphous solid and a liquid.

11. The kit of claim 10, wherein the propellant gas expansion chamber is configured to receive the at least one of the amorphous solid and the liquid from the capsule via the capsule container.

12. The kit of claim 10, wherein the capsule container is configured to receive therein the capsule.

13. The kit of claim 12, wherein the capsule is an ablative cartridge that is removable from the capsule container.

14. The kit of claim 10, wherein the sealed capsule is configured to rupture in response to an application of a pressure wave traveling ahead of the projectile while the capsule is installed in the capsule container, thereby causing least a portion of the contents to be released from the ruptured capsule and into the propellant gas expansion chamber, wherein the released amorphous solid or the released liquid reduces a temperature of the propellant gas associated with the pressure wave, which in turn reduces a pressure of the propellant gas thereby suppressing a noise level associated with the propellant gas as the propellant gas expands into the propellant gas expansion chamber.

15. The kit of claim 10, wherein the at least one of the amorphous solid and the liquid includes at least one of water, antifreeze and a wire pulling polymer lubricant gel.

16. The kit of claim 10, wherein the elongate body is configured to be rotatably coupled to the barrel of the firearm about the longitudinal axis.

17. The kit of claim 10, wherein the elongate body is configured to be slidably coupled parallel to the barrel of the firearm.

18. The kit of claim 10, further comprising the firearm.

19. The kit of claim 18, wherein the firearm is a pistol.

20. The kit of claim 10, further comprising a dustcover, wherein the elongate body is configured to be rotationally aligned with the dustcover.

* * * * *